US005762330A

United States Patent [19]

Quackenbush et al.

[11] Patent Number: 5,762,330

[45] Date of Patent: Jun. 9, 1998

[54] SHEET FEED APPARATUS WITH IMPROVED SHEET SEPARATION AND FRICTION FEED ASSIST

[75] Inventors: Raymond M. Quackenbush, Rochester; Gary E. Nichols, Fairport; James N. Alkins, Holley; Ronald J. Guidice, Rochester, all of N.Y.

[73] Assignee: Eastman Kodak Company, Rochester, N.Y.

[21] Appl. No.: 742,238

[22] Filed: Oct. 31, 1996

[51] Int. Cl.[6] ..... B65H 3/12

[52] U.S. Cl. ..... 271/94; 271/188; 24/258

[58] Field of Search ..... 271/94, 96, 100, 271/106, 107, 161, 188, 196; 24/562, 458

[56] References Cited

U.S. PATENT DOCUMENTS

| | | | |
|---|---|---|---|
| 2,150,497 | 3/1939 | Fernberg | 24/458 |
| 3,003,215 | 10/1961 | Fernberg | 24/562 |
| 4,004,796 | 1/1977 | Macke | 271/94 |
| 4,127,263 | 11/1978 | Wenthe | 271/96 |
| 4,169,674 | 10/1979 | Russel | 355/14 |
| 4,243,316 | 1/1981 | Gustafson | 355/75 |
| 4,245,774 | 1/1981 | Heinz | 24/562 |
| 4,589,648 | 5/1986 | Hancock | 271/106 |
| 4,596,385 | 6/1986 | Silverberg | 271/94 |
| 5,052,675 | 10/1991 | Shehata | 271/94 |
| 5,295,675 | 3/1994 | Hain | 271/94 |
| 5,429,348 | 7/1995 | Martin | 271/96 |

FOREIGN PATENT DOCUMENTS

| | | | |
|---|---|---|---|
| 426699 | 4/1935 | United Kingdom | 271/94 |

OTHER PUBLICATIONS

Hanzlik, Variable Corrugation Vacuum Corrugating Sheet Feeder, Xerox Disclosure Journal, vol. 6 No. 4, Jul./Aug. 1981, page 175.

*Primary Examiner*—H. Grant Skaggs
*Attorney, Agent, or Firm*—Lawrence P. Kessler

[57] ABSTRACT

For use with an apparatus for feeding sheets seriatim from a stack of sheets, the apparatus including a feed tube, such as an oscillating vacuum feed tube for example, defining a plurality of ports through which vacuum is effective for acquiring a sheet from a sheet stack and transporting such sheet from the sheet stack, a device for improving sheet separation and friction feed assist. The disclosed device includes at least one clip associated with at least one port of the feed tube. A friction member is secured to the clip and extends substantially radially outwardly from the oscillating vacuum feed tube so as to cause an acquired sheet to assume a corrugated shape. Accordingly, a sheet of the sheet stack, acquired by the feed tube, assumes a corrugated shape to readily separate from the remaining sheets in the stack, and the friction member assists in feeding of such acquired sheet from the stack.

17 Claims, 3 Drawing Sheets

SHEET FEED APPARATUS WITH IMPROVED SHEET SEPARATION AND FRICTION FEED ASSIST

BACKGROUND OF THE INVENTION

The present invention relates in general to apparatus for feeding sheets seriatim from a stack, and more particularly to a sheet feed apparatus with improved sheet separation and friction feed assist.

In typical commercial electrostatographic reproduction apparatus (copier/duplicators, printers, or the like), a latent image charge pattern corresponding to information to be reproduced is formed on a uniformly charged charge-retentive or photo-conductive member having dielectric characteristics (hereinafter referred to as the dielectric member). Pigmented marking particles are attracted to the latent image charge pattern to develop such image on the dielectric member. A receiver member is then brought into contact with the dielectric member, and an electric field applied to transfer the marking particle developed image to the receiver member from the dielectric member. After transfer, the receiver member bearing the transferred image is transported away from the dielectric member, and the image is fixed (fused) to the receiver member by heat and pressure to form a permanent reproduction thereon.

The rate at which such reproduction apparatus make copies can be quite significant (for example from seventy to one hundred thirty copies per minute). Such high copy rates are possible, at least in part, due to advances in feeding document sheets, bearing information to be reproduced, to and from a copy station. One type of sheet feeder which has been successful in reliably feeding sheets to and from the copy station is commonly referred to as an oscillating vacuum recirculating document feeder. Sheets are withdrawn seriatim, from a sheet stack supported in a tray, by a ported oscillating feed tube, or cylinder. The oscillating feed tube is selectively coupled to a vacuum source. When the ports of the oscillating feed tube are in juxtaposition with the sheet stack, the bottom-most sheet is vacuum tacked to the cylinder. The feed tube is then rotated in a direction to withdraw such sheet from the stack and feed the sheet into a travel path away from the sheet stack.

A pair of driven nip rollers are respectively associated with bearings supported on the oscillating feed tube. The nip rollers cooperate with the bearings to urge the withdrawn sheet in a downstream direction along the travel path. This cooperative arrangement enables a sheet to be transported along the travel path in the downstream direction substantially unimpeded by the oscillation of the oscillating feed tube. Once the sheet is in the nip between the nip rollers and the bearings so as to be under the transport control thereof, the oscillating feed tube can be rotated in the direction reverse to the first direction. Accordingly, the oscillating feed tube will rotate to return the ports to a position for withdrawing the next sheet from the sheet stack.

The described oscillating vacuum recirculating document feeder is very efficient in withdrawing sheets of most typical physical characteristics (e.g., weight, surface finish, etc.) seriatim from the sheet stack. However, some commonly utilized sheets are of materials which have physical characteristics that may adversely effect efficient sheet feeding by the described oscillating vacuum recirculating document feeder. For example, if the sheets are of light weight, the vacuum forces for attracting the bottom sheet may act through the sheet so as to attract more than just the bottom sheet to the oscillating vacuum feed tube and cause the plurality of sheets to be fed at the same time. This obviously will result in copy output which is an incorrect, and unacceptable, page sequential order. Further, if the sheet surface finish has a low coefficient of friction, as is the case with certain coated papers for example, the oscillating vacuum feed tube may fail to feed the bottom sheet from the sheet stack. This too will result in copy output which is an incorrect, and unacceptable, page sequential order.

SUMMARY OF THE INVENTION

In view of the foregoing discussion, this invention is directed to a device for improving sheet separation and friction feed assist for use with an apparatus for feeding sheets seriatim from a stack of sheets. The sheet feed apparatus includes a feed tube, such as an oscillating vacuum feed tube for example, defining a plurality of ports through which vacuum is effective for acquiring a sheet from a sheet stack and transporting such sheet from the sheet stack, a device for improving sheet separation and friction feed assist. The disclosed device includes at least one clip associated with at least one port of the feed tube. A friction member is secured to the clip and extends substantially radially outwardly from the oscillating vacuum feed tube so as to cause an acquired sheet to assume a corrugated shape. Accordingly, a sheet of the sheet stack, acquired by the feed tube, assumes a corrugated shape to readily separate from the remaining sheets in the stack, and the friction member assists in feeding of such acquired sheet from the stack.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
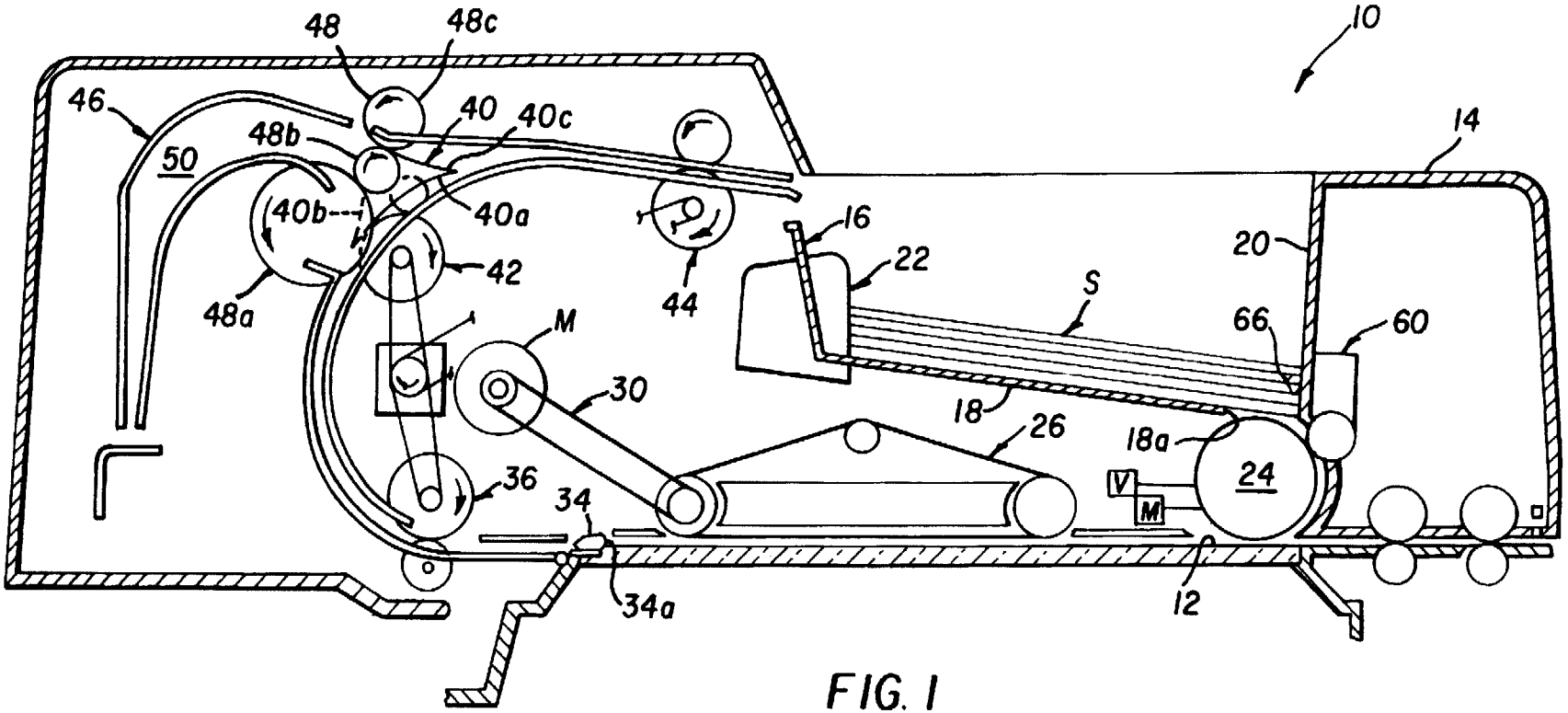
FIG. 1 is a side elevational view, partly in cross-section, of an exemplary oscillating vacuum recirculating document feeder, with portions removed to facilitate viewing.

Referring now to the accompanying drawings, FIG. 1 shows an oscillating vacuum recirculating document feeder, designated generally by the numeral 10, for use with an electrostatographic reproduction apparatus (not shown) of any suitable well known construction and configuration. The oscillating vacuum recirculating document feeder 10 is shown and described as an exemplary document feeder with which the device for improving sheet separation and friction feed assist according to this invention is particularly suitable. Of course, other recirculating document feeder configurations, such as those employing rotating vacuum feed tubes, may utilize this invention.

The oscillating vacuum recirculating document feeder 10 is constructed to present simplex or duplex document sheets in juxtaposition with a transparent platen 12 of a reproduction apparatus so that simplex or duplex reproductions may be made by the reproduction apparatus. The recirculating document feeder 10 includes a housing 14 within which a hopper 16 is located for supporting a set of document sheets S. The hopper 16 comprises a readily accessible tray 18 angled downward from the horizontal toward a striker plate 20. Document sheets placed on the tray 18 by an operator in a particular facial orientation (or returned to the tray by the roller set 44 described below) are urged by gravity against the plate 20 for alignment of the forward edges of such sheets. A jogger and set-completed detector 22 (for example, such as described in U.S. Pat. No. 4,169,674, issued Oct. 2, 1979, in the name of Russel), located at the opposite end of the tray 18, urge the sheet stack up against the plate 20.

A substantially cylindrical oscillating vacuum feed tube 24 is located in juxtaposition with an opening 18*a* in the tray 18. The oscillating vacuum feed tube 24 is selectively activated by a suitable drive mechanism (including a motor M and a vacuum source V) to vacuum tack the bottom sheet in the set S to the peripheral surface thereof, and remove such sheet form the set by rotating in a given direction (clockwise in FIG. 1) to advance such sheet to a transport mechanism 26. The transport mechanism 26 is effective to tack a document sheet for transport relative to the platen 12 (i.e., from right to left in FIG. 1).

During exposure, a document sheet is stopped over the platen 12. To ensure that the document sheet is in proper register so that the reflected light image of the information contained thereon is accurately reproduced on a receiver sheet by the reproduction apparatus, a registration gate 34 is provided adjacent to one edge of the platen 12. The registration gate 34 is movable to a first position intercepting the travel path of a document sheet advanced across the platen, or to a second elevated position out of such travel path to enable the sheet to pass the registration gate (for a more complete description of a suitable registration gate and the mechanism for moving the gate to its first or second position, see for example U.S. Pat. No. 4,243,316, issued Jan. 6, 1981, in the name of Gustafson). When the registration gate 34 is in its first position, the lead surface 34*a* of the gate provides an edge against which a document sheet advanced by the belt 28 of the transport mechanism 26 is stopped at a registered location on the platen; and when the gate is in its second position, the mechanism 26 advances the sheet past the gate to a set of exit nip rollers 36.

The exit nip rollers 36 are driven in the indicated direction, through a belt-and-pulley mechanism, by the motor M'. When reproduction of information contained on only one face of the respective document sheets (e.g., simplex document sheets) in set S is desired, the exit nip rollers 36 advance the sheet form the platen 12 into a path described by guides 38*a*–38*d* and diverter 40 (located in the positions shown in FIG. 1). Additional nip roller sets 42 and 44, also driven for example by motor M', advance the document sheet along such path to return the sheet to the hopper 16. On return to the hopper, the document sheet is received on the top of the set in the same facial orientation as its initial facial orientation in the set. The document sheet set S is initially placed in the hopper 16 with the respective information-containing faces of each sheet being oriented face up. Ideally the document sheet set is in page sequential order with the first page on top. In this manner, the document sheets are advanced seriatim from the hopper 16, last page first, advanced along a travel path with their respective information-containing faces directed toward the platen 12, exposed at the platen, and returned to the hopper in their initial facial orientation. Reproductions of the set would then be made at the full reproduction rate of the reproduction apparatus.

In order to maximize the use of the full reproduction rate of the reproduction apparatus in making reproductions of information contained on both faces of the respective document sheets in a document sheet set S (i. e., duplex document sheets), a turn-over device 46 is provided. To employ the turn-over device 46 for turning over a document sheet, the diverter 40 is moved from its position where its surface 40*a* defines the document sheet travel path for returning a sheet directly to the hopper 16 to a position where surface 40*b* intercepts the document sheet travel path. The document sheet is directed by the surface 40*b* of the diverter 40 and advanced into the chamber 50. When the lead edge of the document sheet strikes the resilient stop member, it rebounds thereby reversing the direction of travel of the document sheet so that the lead edge becomes the trail edge. Due to the shape of the chamber 50 and the beam strength of the document sheet, the new lead edge of the moving document sheet is redirected to advance the sheet over surface 40*c* of the diverter 40. The document sheet is thus returned to the travel path defined by guides 38*c*, 38*d* in a turned over condition for delivery to the hopper 16 with the facial orientation thereof being opposite to its initial facial orientation.

As noted above, recirculating document feeders, particularly of the oscillating vacuum feed tube type, are susceptible under certain conditions to multifeeds with light weight papers or misfeeds with coated smooth papers. With typical vacuum sheet feeders it has been determined that corrugation of the sheet in the sheet stack to be fed from the stack assists in detaching the sheet from the remainder of sheets in the stack. Further, it has been determined that increasing the coefficient of friction of the material effecting sheet feeding assists in advancing coated smooth paper sheets. Therefore, the device according to this invention, designated generally by the numeral 60, is provided for the oscillating vacuum feed tube 24 to improve sheet separation and friction feed assist.

Figure 2:
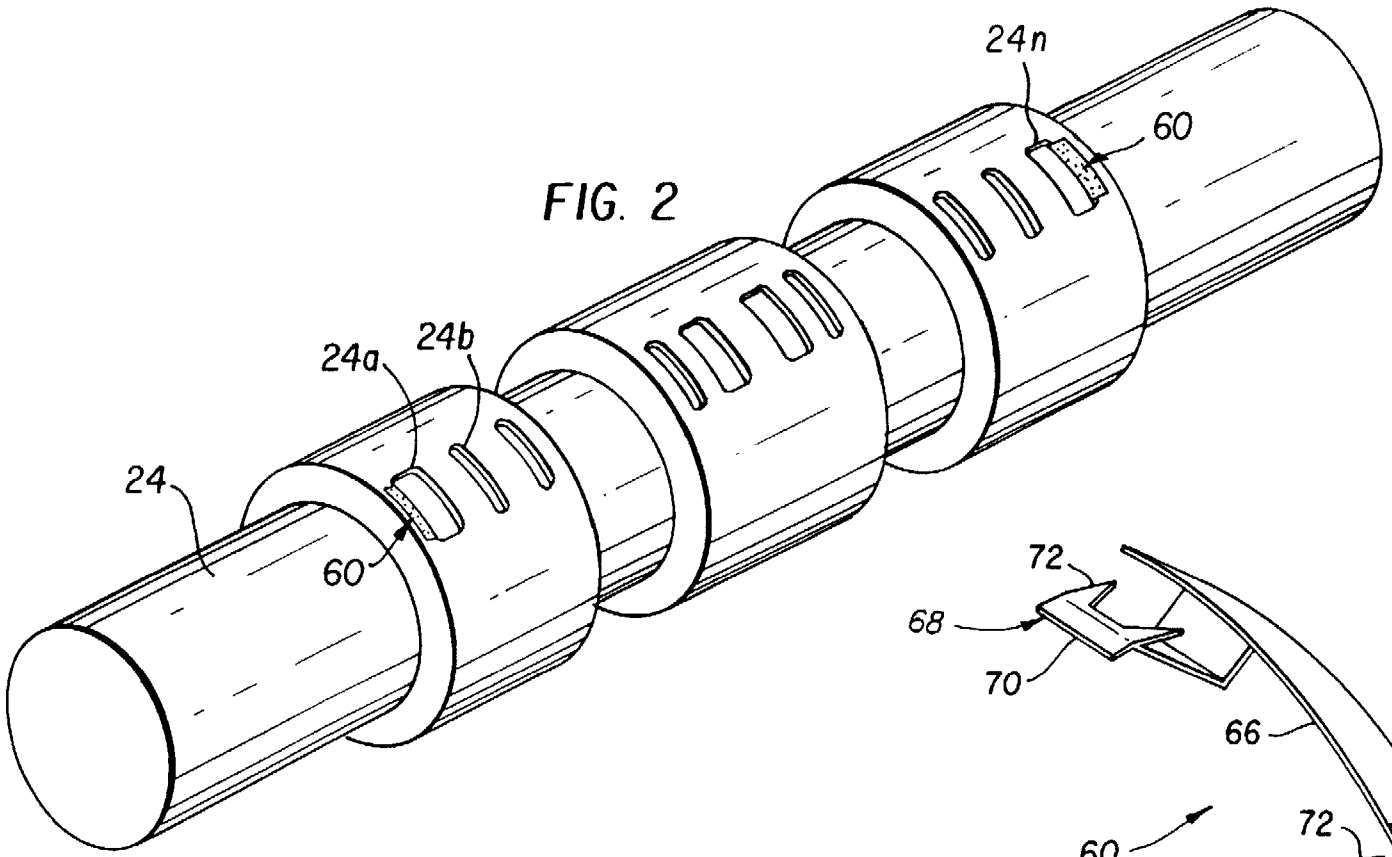
FIG. 2 is a view, in perspective and on an enlarged scale, of the oscillating vacuum feed tube of the recirculating document feeder, including the device for improving sheet separation and friction feed assist, according to this invention.
Figure 4:
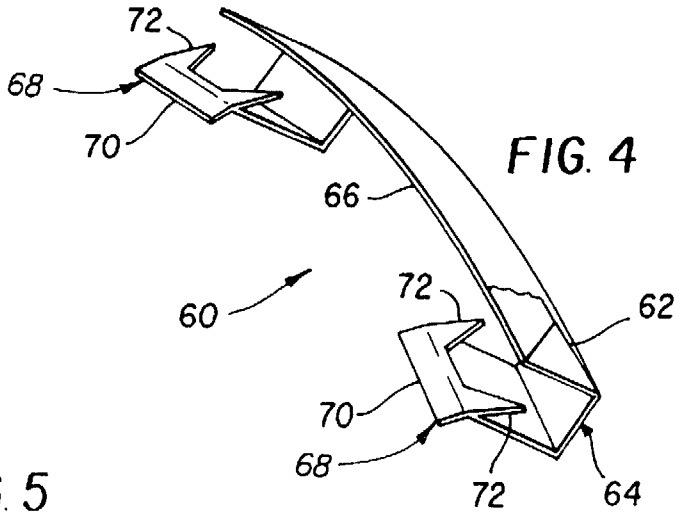
FIG. 4 is a view, in perspective, of the device for improving sheet separation and friction feed assist according to this invention, with portions broken away to facilitate viewing.
Figure 5:
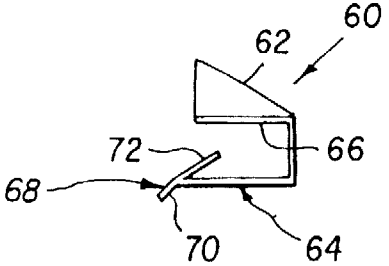
FIG. 5 is a side elevational view, on an enlarged scale of the device for improving sheet separation and friction feed assist, according to this invention.
Figure 3:
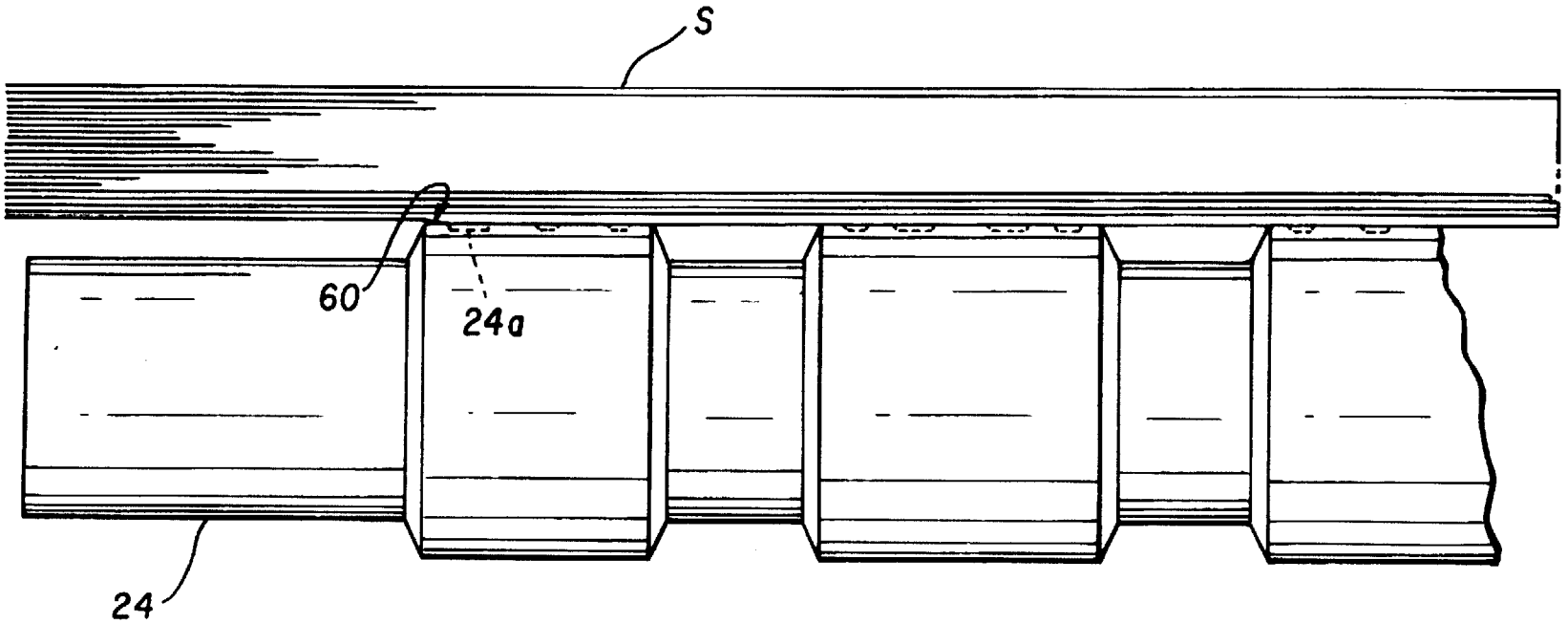
FIG. 3 is a front elevational view, on an enlarged scale, of the oscillating vacuum feed tube of the recirculating document feeder, including the device for improving sheet separation and friction feed assist, as shown in FIG. 2.

The device 60 includes a friction member 62 attached to a clip 64. The configuration for the clip 64 is such that the clip can be readily securely attached to the oscillating vacuum feed tube 24. As shown in FIGS. 2 and 3, the oscillating vacuum feed tube 24 has a plurality of aligned ports 24*a*, 24*b*. . . 24*n*. As discussed above, the ports are aligned, along an element of the feed tube, with the opening 18*a* in the tray 18 of the recirculating feeder apparatus 10 so that applied vacuum effects the acquisition of the bottom sheet from the sheet stack S on the tray. Oscillation of the feed tube 24 causes the transport of the acquired sheet to the downstream roller nip, and the feed tube returns to realign the ports 24*a*, 24*b*. . . 24*n* with the opening 18*a* to be ready to acquire the next sheet in the sheet stack S.

The friction member 62 is formed of a material having a relatively high coefficient of friction. An exemplary material for the friction member 62 is polyurethane having a coefficient of friction in the range of about 1.6 to 1.8, for example, and a hardness in the range of about 60 to 80 on the Shore A hardness scale. The friction member 62 has a wedge-shaped cross-sectional area, the bottom edge 62*a* of which is secured to a portion 66 of the clip 64 in any known manner, such as for example by a suitable adhesive. The location of the friction member 62 relative to the clip 64 is such that the cross-sectional dimension increases away from the associated feed tube port.

The wedge-shaped friction member support portion 66 of the clip 64 of each device 60 is slightly shorter than the dimension of the oscillating vacuum feed tube ports, measured in the direction of tube oscillation. Further, the portion 66 is of sufficient flexibility to conform to the curvature of the oscillating vacuum feed tube. Alternatively, the portion 66 may be of an arcuate shape, with a radius of curvature substantially equal to the radius of the oscillating vacuum feed tube 24.

Brackets 68 are connected respectively to the friction member support portion 66 adjacent to the ends thereof. The brackets 68 respectively include a lead edge guide ramp 70 and gripping teeth 72. The guide ramps 70 facilitate placement of the clip 64 of the device 60 on to the edge of an oscillating vacuum feed tube port, while the gripping teeth 72 are oriented in a direction so as to serve to hold the device in place on the tube during operation.

In operation of the device 60 as described, according to this invention, the clips 64 are attached to the feed tube 24 adjacent to the outboard edges of the extreme ports (ports 24*a* and 24*n* as shown in FIGS. 2 and 3). With the described attachment of the clips 64 to the oscillating vacuum feed tube 24, the friction members 62 of the respective devices 60 extend substantially radially from the oscillating vacuum feed tube 24, and thus cause the bottom sheet in the stack S to assume a corrugated shape as it is acquired (see FIG. 3). This assures that the sheet will detack from the remaining sheets of the stack. Further, the friction members 62, due to their coefficient of friction, assist in friction feeding of coated smooth papers.

Of course, depending upon the size and spacing of the vacuum feed tube ports, any particular number of devices 60 may be associated with selected ports other than the extreme ports as described. Furthermore, it is understood that when the wedge-shaped member 62 of a particular device 60 wears down, such device may be readily removed and replaced, such as by using the ramp 70 to facilitate prying open of the clip 64. It should also be noted that the devices 60, as associated with the feed tube 24 of the recirculating document feeder 10, prevent undue frictional wear of the oscillating vacuum feed tube itself, and thus significantly prolong the useful life of the tube.

The invention has been described in detail with particular reference to the preferred embodiment thereof, but it will be understood that variations and modifications can be effected within the spirit and scope of the invention as set forth in the claims.

What is claimed is:

1. For use with an apparatus for feeding sheets seriatim from a stack of sheets, said apparatus including a feed tube, defining a plurality of ports through which vacuum is effective for acquiring a sheet from a sheet stack and transporting such sheet from said sheet stack, a device for improving sheet separation and friction feed assist, said device comprising:

at least one clip adapted to be associated with at least one port of said feed tube; and a friction member secured to said clip to extend substantially radially outwardly from said feed tube when said clip is associated with said feed tube so as to cause an acquired sheet to assume a corrugated shape;

whereby a sheet of said sheet stack, acquired by said feed tube, assuming such corrugated shape, readily separates from the remaining sheets in said stack, and said friction member assists in feeding of such acquired sheet from said stack.

2. The sheet separation and friction feed assist device according to claim 1 wherein said clip is readily removably attachable to said feed tube adjacent to a port thereof.

3. The sheet separation and friction feed assist device according to claim 1 including a plurality of clips adapted to be associated with a plurality of feed tube ports respectively.

4. The sheet separation and friction feed assist device according to claim 3 wherein said plurality of clips are readily removably attachable to said feed tube respectively adjacent to said plurality of feed tube ports at an outboard edge of such ports.

5. The sheet separation and friction feed assist device according to claim 4 wherein each of said clip includes a support portion and brackets adjacent to the ends of said support portion.

6. The sheet separation and friction feed assist device according to claim 5 wherein said brackets include lead edge guide ramps oriented in a direction to facilitate attaching said clip to said feed tube.

7. The sheet separation and friction feed assist device according to claim 5 wherein said brackets include gripping teeth oriented in a direction so as to serve to hold said clip in place on said feed tube.

8. The sheet separation and friction feed assist device according to claim 5 wherein said brackets include lead edge guide ramps oriented in a direction to facilitate attaching said clip to said feed tube, and gripping teeth oriented in a direction so as to serve to hold said clip in place on said feed tube.

9. The sheet separation and friction feed assist device according to claim 5 wherein said support portion of said clip is flexible so as to enable said portion to substantially conform to the curvature of said feed tube when associated with said feed tube.

10. The sheet separation and friction feed assist device according to claim 3 wherein said friction member is wedge shaped, increasing in cross-sectional dimension away from said associated feed tube port when associated with said feed tube.

11. For use with an apparatus for feeding sheets seriatim from the bottom of a stack of sheets, said apparatus including a substantially cylindrical oscillating vacuum feed tube, defining a plurality of ports aligned substantially along an element of said oscillating vacuum feed tube, for acquiring a sheet from the sheet stack and transporting such sheet from said sheet stack, a device for improving sheet separation and friction feed assist, said device comprising:

a plurality of clips adapted to be readily removably attachable to said ported oscillating vacuum feed tube adjacent to respective ports of said plurality of aligned ports; and a friction member secured to each of said clips to extend substantially radially outwardly from said oscillating vacuum feed tube when said clips are associated with said feed tube so as to cause an acquired sheet to assume a corrugated shape;

whereby the bottom sheet of said sheet stack acquired by said oscillating vacuum feed tube assumes a corrugated shape to separate from the remaining sheets in said stack, and said friction member assists in feeding of such acquired sheet from said stack.

12. The sheet separation and friction feed assist device according to claim 11 wherein said plurality of clips include a pair of clips readily removably attachable to said oscillating vacuum feed tube, adjacent respectively to the pair of extreme ports of said plurality of aligned ports of said oscillating vacuum feed tube, adjacent to an outboard edge of said extreme ports.

13. The sheet separation and friction feed assist device according to claim 12 wherein each of said clip includes a support portion and brackets adjacent to the ends of said support portion.

14. The sheet separation and friction feed assist device according to claim 13 wherein said brackets include lead edge guide ramps oriented in a direction to facilitate attaching said clip to said oscillating vacuum feed tube, and gripping teeth oriented in a direction so as to serve to hold said clip in place on said oscillating vacuum feed tube.

15. The sheet separation and friction feed assist device according to claim 14 wherein said support portion of said clip is flexible so as to enable said portion to substantially conform to the curvature of said feed tube when associated with said feed tube.

16. The sheet separation and friction feed assist device according to claim 11 wherein each of said friction members is wedge shaped, respectively increasing in cross-sectional dimension away from said associated feed tube port when associated with said feed tube.

17. The sheet separation and friction feed assist device according to claim 16 wherein each of said friction members has a coefficient of friction in the range of about 1.6 to 1.8, and a hardness in the range of about 60 to 80 on the Shore A scale.

* * * * *